US007621695B2

(12) United States Patent
Smith et al.

(10) Patent No.: US 7,621,695 B2
(45) Date of Patent: Nov. 24, 2009

(54) SUBSURFACE STORMWATER SYSTEM

(76) Inventors: Paddy Smith, The Office, Killoughter Cottage, Ashford, County Wicklow (IE); Kieran Smith, The Office, Killoughter Cottage, Ashford, County Wicklow (IE)

( * ) Notice: Subject to any disclaimer, the term of this patent is extended or adjusted under 35 U.S.C. 154(b) by 37 days.

(21) Appl. No.: 11/815,075

(22) PCT Filed: Feb. 6, 2006

(86) PCT No.: PCT/EP2006/001062

§ 371 (c)(1),
(2), (4) Date: Oct. 24, 2007

(87) PCT Pub. No.: WO2007/054130

PCT Pub. Date: May 18, 2007

(65) Prior Publication Data

US 2008/0166182 A1 Jul. 10, 2008

(30) Foreign Application Priority Data

Feb. 4, 2005 (EP) ..... 05100810

(51) Int. Cl.
*E02B 11/00* (2006.01)

(52) U.S. Cl. ..... 405/43; 405/36; 405/53; 210/170.03

(58) Field of Classification Search ..... 405/36, 405/43–45, 50, 52, 53, 55; 210/170.03, 170.01, 210/170.07
See application file for complete search history.

(56) References Cited

U.S. PATENT DOCUMENTS 3,280,569 A 10/1966 Wosenitz
4,246,305 A * 1/1981 Delattre ..... 405/50
5,810,510 A * 9/1998 Urriola ..... 405/45
6,095,718 A * 8/2000 Bohnhoff ..... 405/52
6,428,870 B1 * 8/2002 Bohnhoff ..... 428/44
6,648,549 B1 * 11/2003 Urriola ..... 405/45
6,736,569 B2 * 5/2004 Lee ..... 405/50
6,779,946 B1 * 8/2004 Urriola et al. ..... 405/43
7,056,058 B2 * 6/2006 Urriola et al. ..... 405/43
7,080,480 B2 * 7/2006 Urban et al. ..... 405/53

(Continued)

FOREIGN PATENT DOCUMENTS

DE 29924050 U1 10/2001

(Continued)

*Primary Examiner*—Frederick L Lagman
(74) *Attorney, Agent, or Firm*—Porter Wright Morris & Arthur, LLP

(57) ABSTRACT

A cubic modular subsurface stormwater unit has equal top and bottom surfaces spaced apart by a set of four pillars, each of which runs from a corner of the top surface to a corresponding corner of the bottom surface. The pillars define a void having a generally cruciform cross section, the void opening onto each of the four side faces defined between the roof and the base. A line of units connected together in series side to side will have a long throughway formed by the respective voids in each unit, and a regular matrix of X- and Y-axis throughways will be formed as units are connected laterally on all sides. The unit is formed of identical halves which can be connected together in any orientation due to the square configuration and to a mating connection which has mating parts symmetrically disposed about a diagonal corner-to-corner line.

13 Claims, 15 Drawing Sheets

U.S. PATENT DOCUMENTS

| | | | | |
|---|---|---|---|---|
| 2004/0091320 | A1 * | 5/2004 | Parker | 405/45 |
| 2007/0217866 | A1 * | 9/2007 | Oscar | 405/36 |

FOREIGN PATENT DOCUMENTS

| | | | |
|---|---|---|---|
| EP | 1036638 | A | 9/2000 |
| EP | 1416099 | A2 * | 5/2004 |
| EP | 1743984 | A1 * | 1/2007 |
| GB | 2417733 | A * | 3/2006 |

* cited by examiner 42
14
48
40
52
44
46
54
50

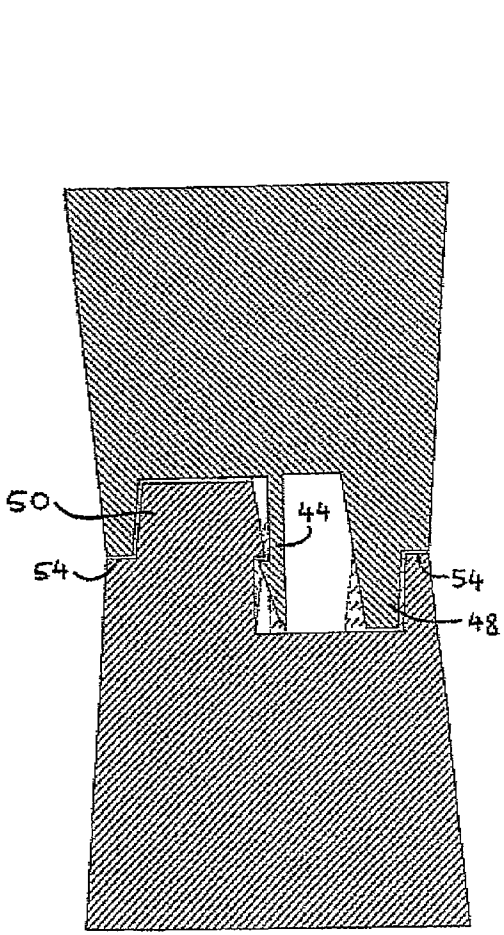
(B)
FIG. 11
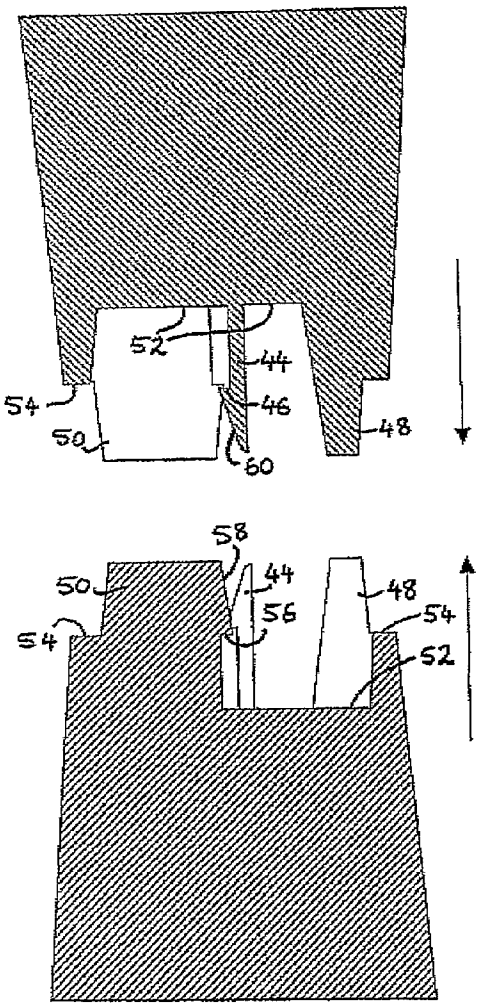
(A)

SUBSURFACE STORMWATER SYSTEM

This invention relates to subsurface stormwater (or waste water) systems.

Subsurface stormwater systems are used in construction to both provide a structural support layer and to receive and disperse excess water. Such systems replace the traditional aggregate used for these purposes. These systems have application in paved areas such as carparks and roads, and in building foundations. Further applications include linear drainage systems in which conventional drainage pipes can be replaced by stormwater attenuation systems covered in geotextile, and soakaway systems which have application, for example, in attenuating floodwater in a roadside field to prevent flooding of the road.

It is desirable to allow easy inspection of such systems to enable blockages to be easily located and to enable routine maintenance tasks.

While modular systems (built up of a number of identical units) are known, there is a need to provide modular systems which can be more easily assembled and maintained than heretofore.

In a first general aspect, the invention provides a modular subsurface stormwater unit of generally cuboid external form having equal rectangular top and bottom surfaces spaced apart by a set of four pillars, each of which runs from a corner of the top surface to a corresponding corner of the bottom surface, said pillars defining therebetween a void having a generally cruciform cross section, said void opening onto each of the four side faces defined between the roof and the base.

With this construction, the cuboid units can be connected together side to side, such that the void opening between a pair of pillars on one unit matches the void opening on another unit. The two voids thus connect together, and a throughway is created between an arm of the cruciform void on one unit and an arm on the cruciform void of another unit. A line of units connected together in series side to side will have a long throughway formed by the respective voids in each unit. Thus, if any single unit's cruciform void is illustrated by a plus sign (+), the throughway can be visualised by the horizontal line in formed in a row of adjacent "plus" symbols: ++++++. It will be readily appreciated that a regular matrix of X- and Y-axis throughways will be formed as units are connected laterally on all sides.

Where it is specified above that the pillars each rum from a corner of the top surface to a corner of the bottom surface, it is to be understood that the pillars need not be at the apexes of the corners. It is sufficient if each pillar is located generally towards its respective corner, so that the space between the pillars is generally cruciform. There can be a lateral gap between the outermost part of any pillar and the actual corner apex of the top and/or bottom surface.

This aspect of the invention provides a network of perpendicular tunnels in a system of adjacent modular units, aiding in inspection and maintenance of the system, and also allowing uninterrupted flow of liquid through the system with less chance of blockages occurring in the first place.

Preferably, the cuboid units are in fact generally cubic and thus the rectangular top and bottom faces are in fact square and equal to each of the four side faces. Cubic units are easier to stack alongside one another without requiring any particular orientation, other than to ensure that the top and bottom surfaces (which can be identical, so that there is no distinction between the top face and the bottom face) are at the top and bottom.

In another independent aspect the invention provides a sub-unit of a modular subsurface stormwater unit, the sub-unit comprising a generally square face (which provides a top or bottom face of a finished unit) having a set of four half-pillars extending therefrom, one at each corner of the face, each half-pillar terminating at a mating connection which is adapted to mate with an identical mating connection of another identical sub-unit to provide a generally cuboid modular unit, the mating connections of the four half-pillars being disposed such that when two sub units are brought into engagement with their square faces aligned and the mating connections approaching one another, each of the mating connections on one sub-unit engages with a complementary mating connection on the other sub-unit, for each of the four aligned orientations of the two square faces.

To put this more simply, if each mating connection has a clip which snaps onto an identical clip on another unit each clip is disposed such that it will be brought into engagement to connect to an identical clip, even if one of the sub-units is rotated though 90, 180 or 270 degrees relative to the other.

Preferably, each mating connection has a first structure and a complementary second structure, the first and second structures being arranged such that when two sub-units are brought into engagement as aforesaid each first structure on one of said sub-units is aligned with and engages with a second structure on the other of said sub-units and vice versa, and this remains true, even if one of the sub-units is rotated through 90, 180 or 270 degrees relative to the other.

Another way of considering this aspect of the invention is to examine a plan view of the set of mating connections on a sub-unit taken from above (i.e. from the side distant from the square face) and a plan view taken from below (from the side of the mating connections on which the square face is located). If the first structures are male projections and the second structures are female recesses, the invention provides that when the two plan views are superimposed, all of the male parts will overlie female parts and vice versa, this again being true when one of the views is rotated through a multiple of 90 degrees.

The advantage of this arrangement is that any two sub-units, selected at random, can be assembled directly together without any concern for the relative orientation of the two sub-units, thereby providing quick and easy assembly of units on-site by individuals having little familiarity with the product.

In a particularly preferred sub-unit, each pair of first and second structures is arranged such that when projected onto the plane of the square face, the first and second structures are symmetrically disposed about a notional diagonal extending from one corner of the square face to the opposite corner.

Thus, if the mating connection on a given half-pillar comprises a peg and a complementary hole, the peg and hole will preferably be on opposite sides of the diagonal extending from that half-pillar to the opposite corner, with the line connecting the peg and hole being perpendicular to that diagonal.

In a third independent aspect, the invention provides a modular subsurface stormwater unit of generally cuboid external form having equal rectangular top and bottom surfaces spaced apart by a set of four pillars, each of which runs from a corner of the top surface to a corresponding corner of the bottom surface, said pillars defining therebetween a void having a generally cruciform cross section, wherein the top surface is provided with a central cut-out between the pillars to enable an inspection access point to be readily created in the top of any such unit in a system of laterally adjoined units by removing said cut-out.

Prior art stormwater attenuation systems are typically either not inspectable once installed, or are only inspectable from limited sites. For example, such systems may have inspection chambers running along a single axis from one end to the other, with inspection being achieved via a manhole which is positioned to allow access to an end of al inspection chamber.

In contrast the invention, in its third independent aspect provides each unit with an inspection access point (into which a camera or other inspection device may be lowered), and provides the potential for inspection along X and Y axes. Furthermore, when units are stacked, the cut-outs in vertically adjacent units can be cut away to allow inspection to occur in any of the layers of the system.

The invention will now be further illustrated by the following description of embodiments thereof given by way of example only with reference to the accompanying drawings, in which:

FIG. 11A shows a schematic cross-section of a pair of half-pillars aligned for connection;

FIG. 11B shows a schematic cross-section of a pair of half-pillars when connected;

Figure 1:
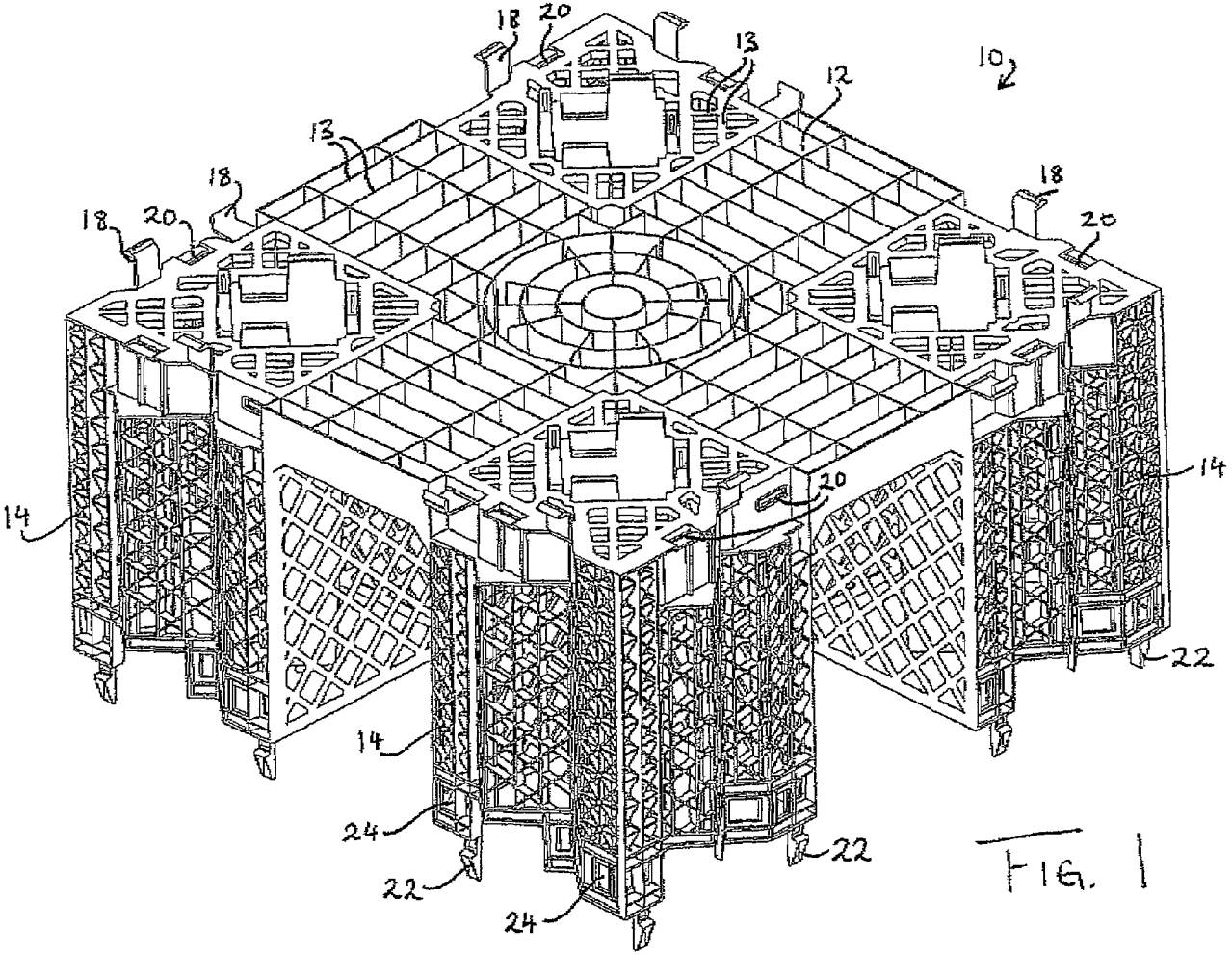
FIG. 1 is a perspective view from above of a sub-unit according to the invention of a modular subsurface stormwater unit.
Figure 2:
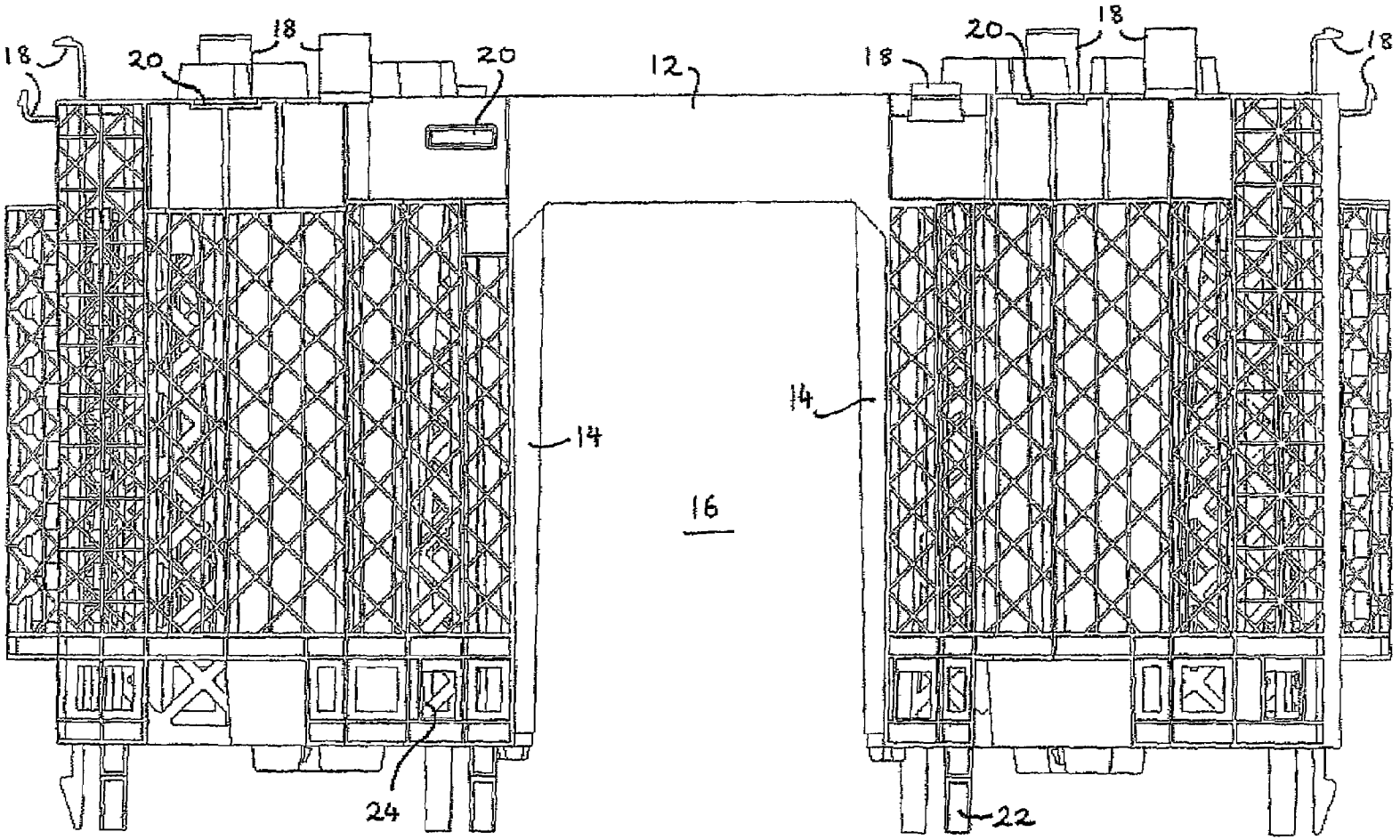
FIG. 2 is a side elevation of the sub-unit of FIG. 1.
Figure 3:
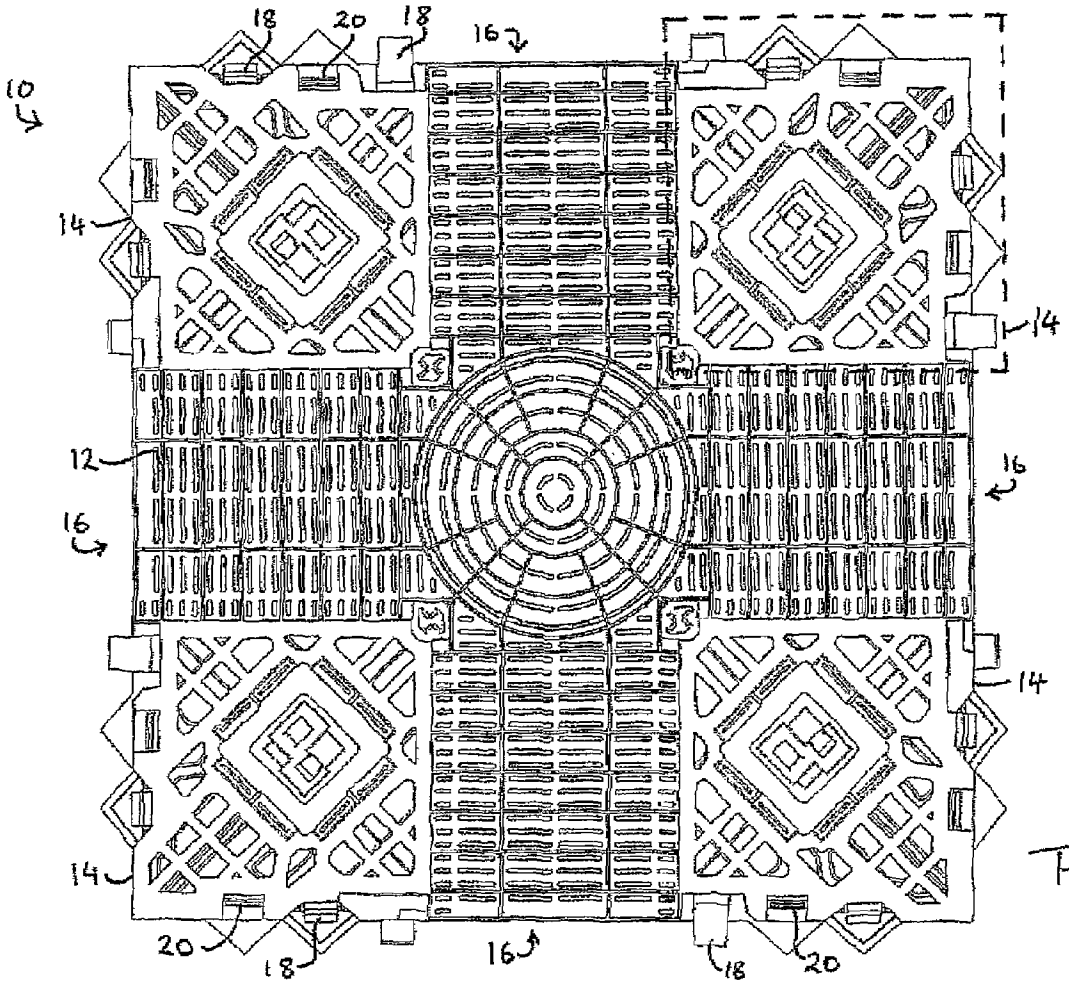
FIG. 3 is a plan view from above of the sub-unit of FIG. 1.

Referring to FIGS. 1, 2 and 3, a sub-unit of the invention is shown, generally at 10. The sub-unit has a generally square face 12 which provides either a top or bottom face of a finished unit. This will be referred to for convenience as the top face but it is to be understood that the embodiment is not limited to such orientation. It is also to be understood that the term "face" refers not to a continuous surface but rather to the porous surface defined by the lattice network of ribs and struts 13.

A half-pillar 14 extends from each corner of the underside (internal side) of face 12. When viewed from any side (FIG. 2), the side "face" of the sub unit is formed of the outer surface of a pair of half pillars 14 and an opening 16 which leads to a channel running through to the opposite side face without interruption. As seen in FIG. 3, therefore, the four generally square pillars (one of which is indicated by surrounding broken lines) define between themselves a cruciform void, i.e. a pair of channels intersecting at right angles and opening onto each side where indicated at 16.

A number of clips 18 and slots 20 are provided to enable adjacent units to be connected to one another as will be explained in greater detail below. As can be seen in FIGS. 1 and 2, locking clips 22 and receiving holes 24 are also provided at the end of each half pillar 14 to enable two opposed half-pillars to interengage one another.

Figure 4:
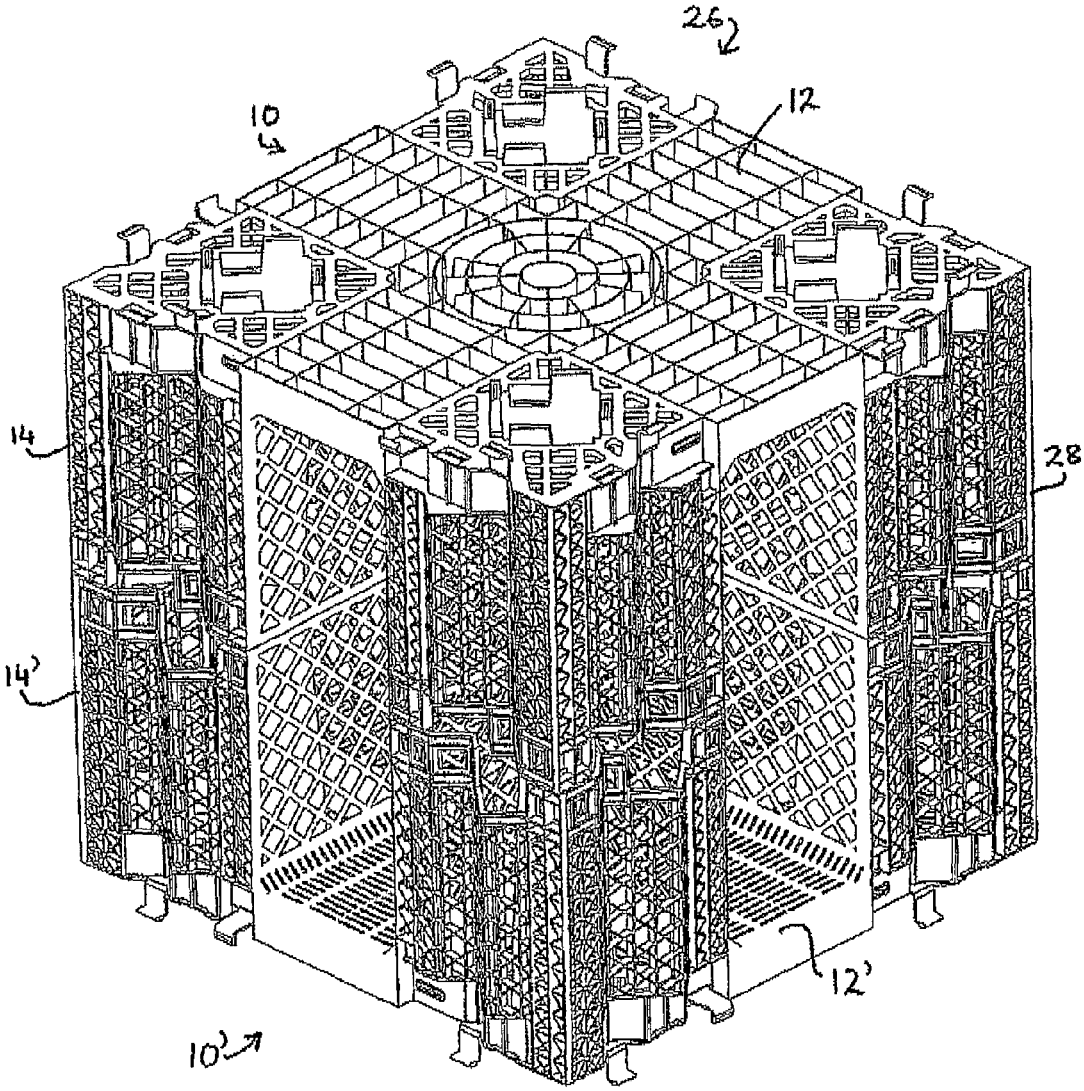
FIG. 4 is perspective view of a pair of sub-units, assembled into a modular subsurface stormwater unit according to the invention.
Figure 5:
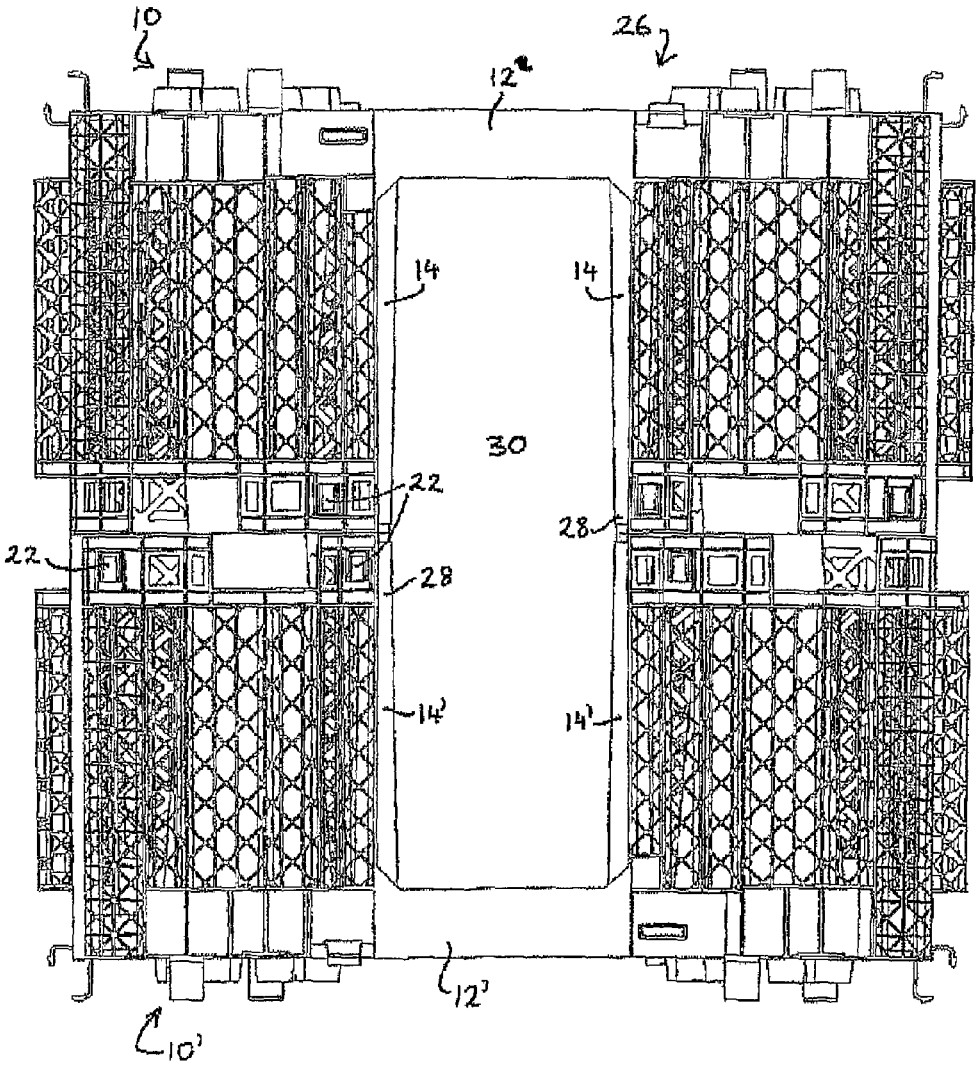
FIG. 5 is a side elevation of the unit of FIG. 4.

FIGS. 4 and 5 show a pair of sub-units interconnected in this way to form a modular unit 26. An upper sub-unit 10 and a lower sub-unit 10' are connected with the respective half pillars 14, 14' combining along each corner to form vertical pillars 28, one pillar at each corner. Each of the four pillars 28 runs from the top face 12 of the unit to the bottom face 12' of the unit 26. Each side of the thus formed cubic unit comprises the external surface of a pair of pillars 28 and a void opening 30 resulting from the openings 16 in the sub-units. It will be readily understood that the internal chamber leading from the void opening defined between the four pillars 28 extend from top face 12 to bottom face 12' and is of cruciform cross-section, i.e. the intersection of a pair of passageways each extending without interruption from one side face to the opposite side face.

The sub-units are held together, in part by the clips 22 and receiving holes 24 shown in FIGS. 1 and 2. In FIG. 5 one can see three of the clips 22 located within the receiving holes. A further and more sturdy connection is provided internally inside the pillars and will be described in more detail below.

Figure 6:
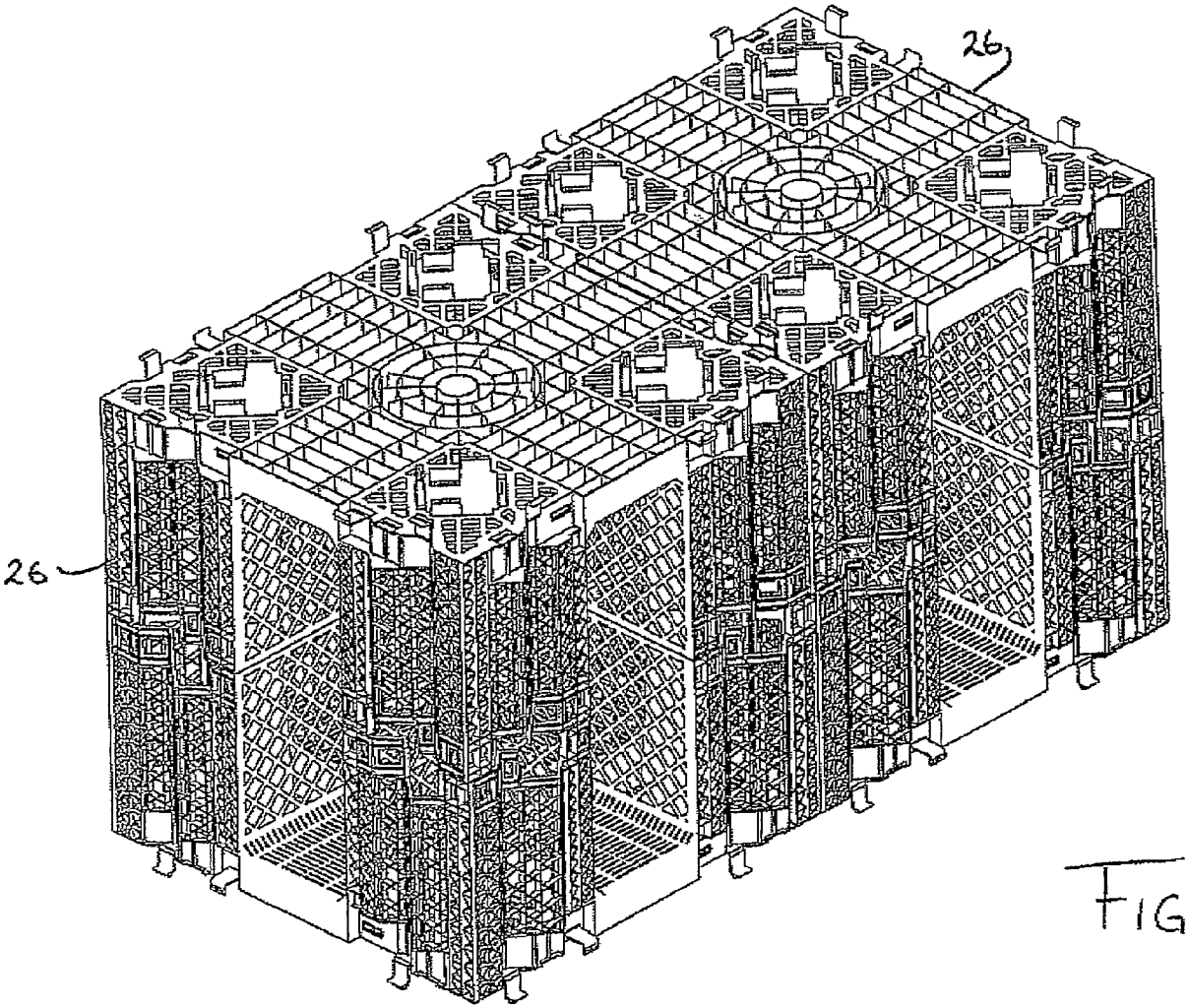
FIG. 6 is a perspective view of modular stormwater system according to the invention comprising a pair of units connected laterally.

When a pair of sub-units has been assembled as shown in FIGS. 5 and 6, the modular unit 26 thus provided can then be connected both laterally and vertically to like units along the X, Y and Z directions defied by the axes of the cubic units.

Figure 7:
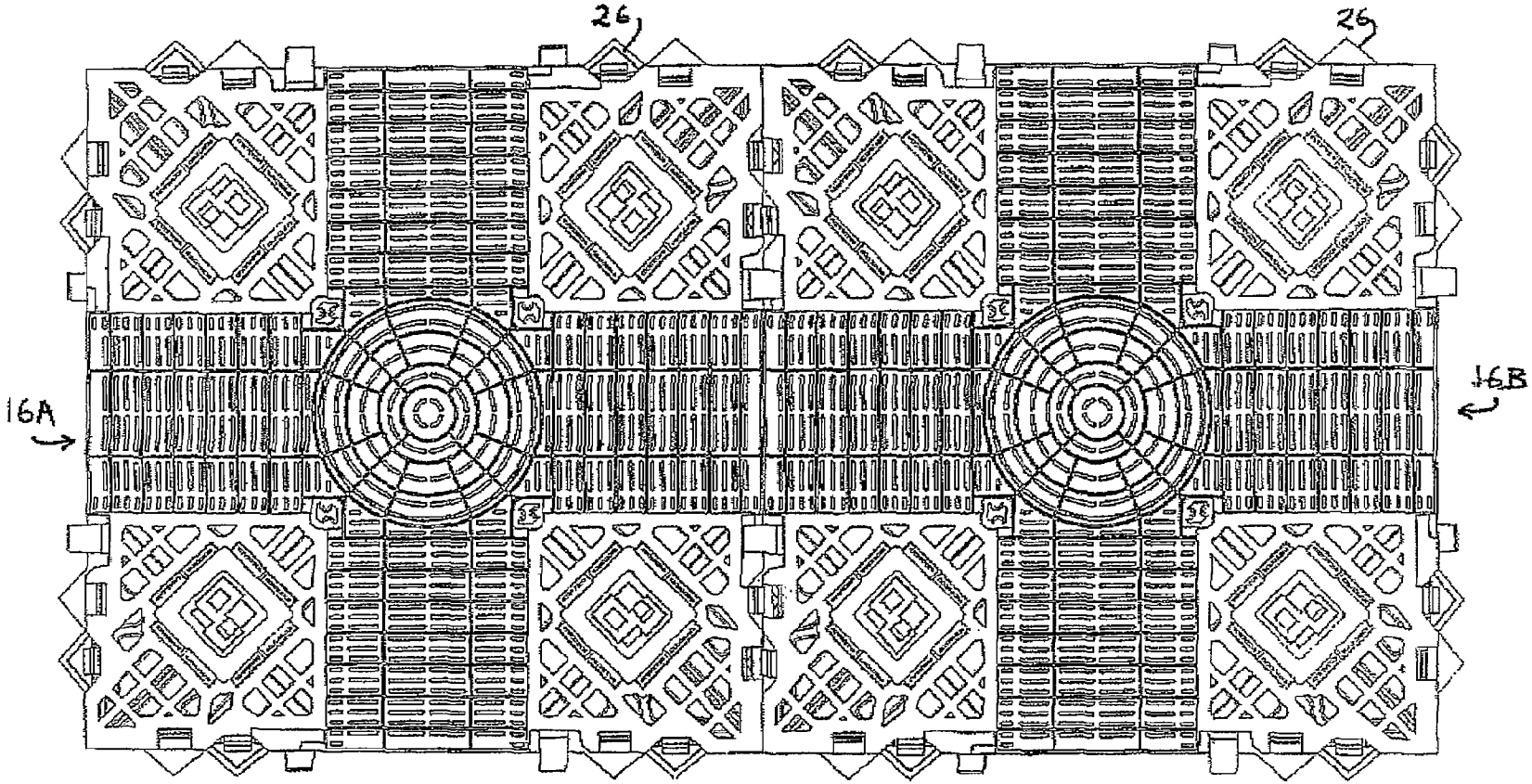
FIG. 7 is a plan view of the system of FIG. 6.

FIGS. 6 and 7 show a pair of units 26 connected laterally. It can be seen that the internal cruciform voids in the paw of units are aligned such that an uninterrupted throughway extends from opening 16A to opening 16B (FIG. 7). As the finished system will in most cases comprises large numbers of such units connected in laterally on all sides to form a continuous block it will be appreciated that the cruciform voids will be aligned in every pair of adjacent units to provide a matrix of uninterrupted throughways extending through the system.

This provides three major advantages. Firstly, the lack of any blocking structures between pillars significantly reduces the chance of debris carried in stormwater or other runoff water getting jammed and causing a blockage in the system. Secondly, if a blockage does occur for any reason, the blocked section of the passage is simply bypassed as water flows through the channels of adjacent units. Thirdly, because each unit in the system is interconnected to every other unit with a generous system of voids, inspections cam be more easily done from any access point. In particular, a clear line of sight through the system along each row and column of units makes spotting and locating blockages or damage to the system extremely easy.

Figure 8:
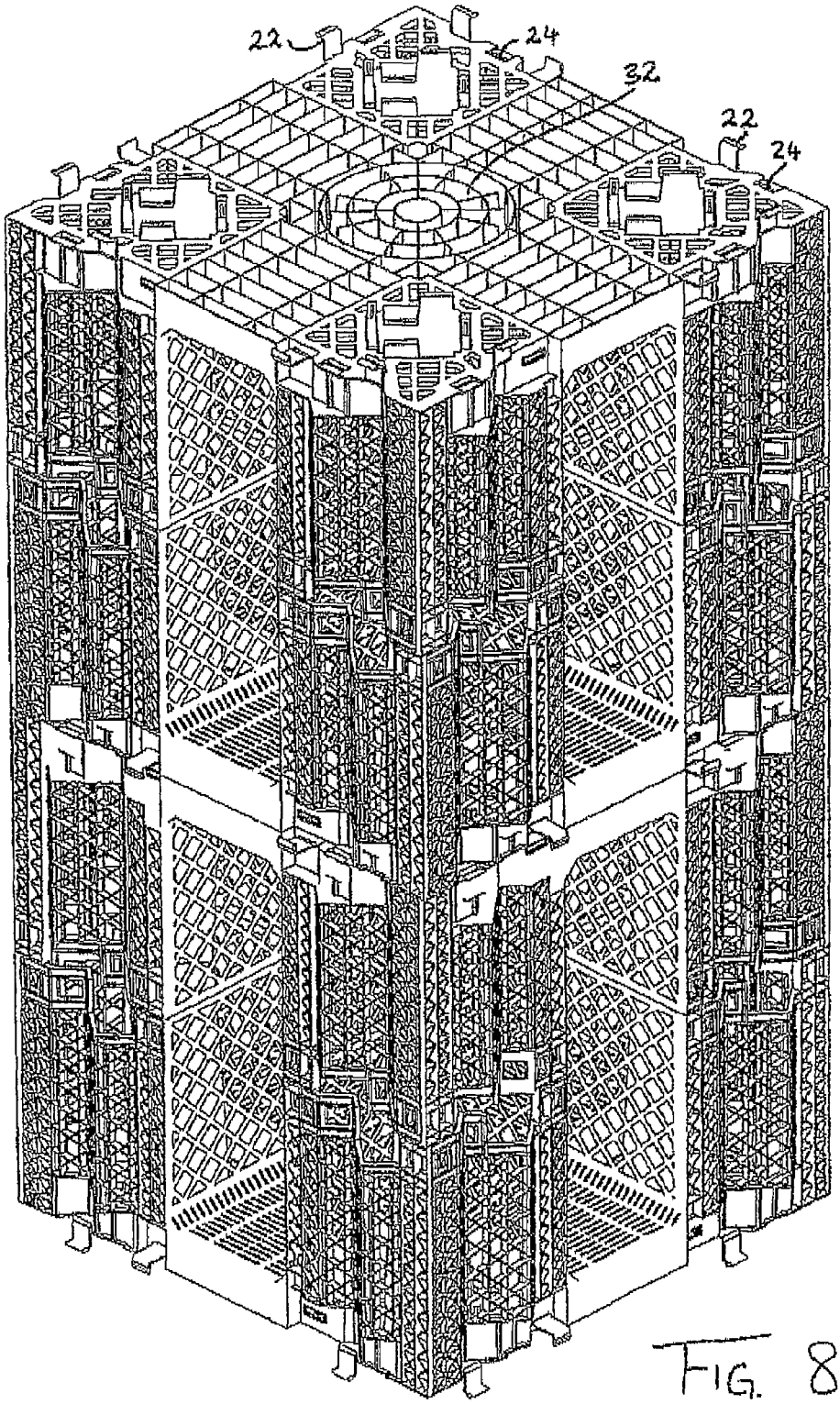
FIG. 8 is a perspective view of modular stormwater system according to the invention comprising a pair of units connected vertically.

As seen in FIG. 8, units 26 and 26' can be stacked vertically as well as laterally. As with the lateral connection, the clips 22 and holes 24 on the peripheral edges of the units are used to quickly attach units together to build up a three dimensional system.

In the centre of the top and bottom face of each unit a circular structure 32 provides a cut-out section allowing a length of pipe or duct (not shown) to be attached onto the top of the system where a unit is located below a manhole or other access area. Because the circular cutouts of stacked units (as seen in FIG. 8) coincide, the cut-outs can be removed from both the top and bottom faces of upper unit 26, and from the top face of lower unit 26', to provide access to not only lower unit 26', but also to the entire layer of laterally connected units (not shown in FIG. 8) of which unit 26' forms part. The circular cut-out features are described in greater detail below.

As indicated previously, the connection between a pair of sub-units is effected not only by the peripheral clips, but also by a connection internally of the pillars 28 formed by two abutting half-pillars 14. Referring to FIGS. 9, 10, 11A, 11B and 12, this structure and method of connection is now described.

Figure 9:
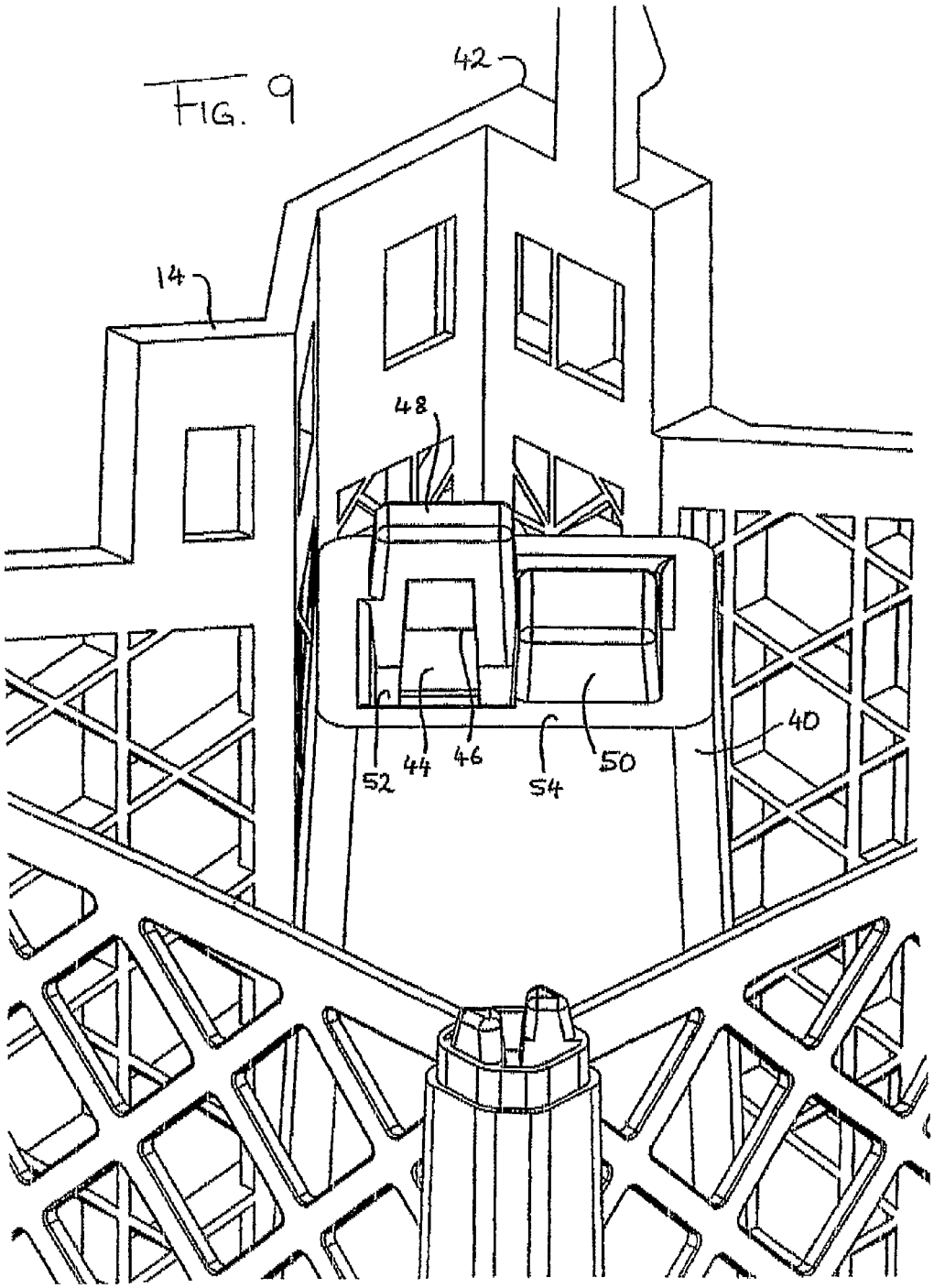
FIG. 9 is a perspective view of a detail at the end of a half-pillar of the sub-unit of FIG. 1.
Figure 10:
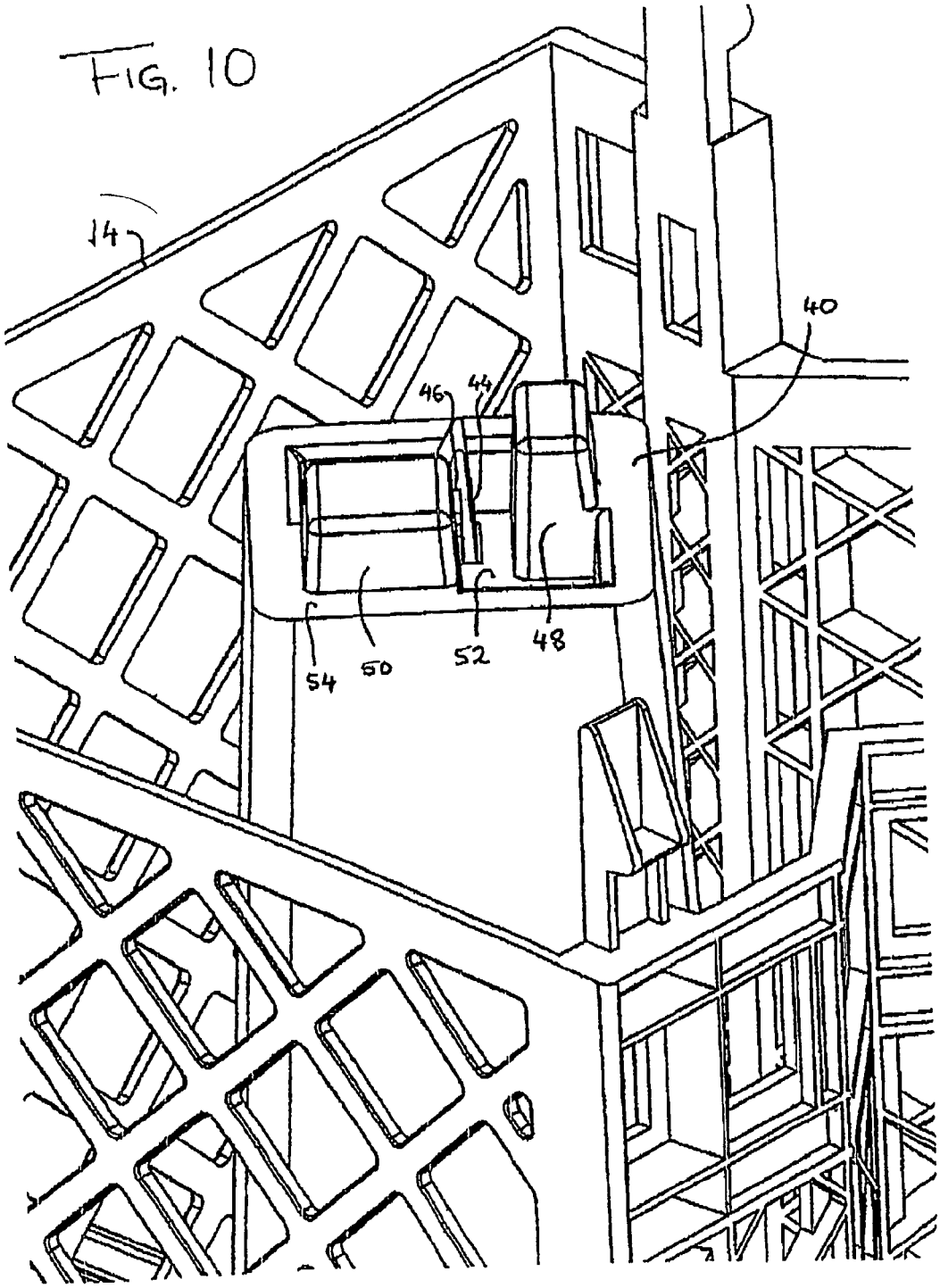
FIG. 10 is a perspective view of the detail of FIG. 9, taken along a transverse direction.

Each half-pillar includes an internal support post 40 from which the half-pillar 14 derives most of its vertical compressive strength to the pillars. FIG. 9 shows one such support post 40 in a perspective view taken from the direction of the centre of the sub-unit towards an outer corner point 42 of the half-pillar 14, while FIG. 10 shows the support post in a perspective view taken along a perpendicular direction, i.e. across a corner of the sub-unit.

At the termination of the support post 40 three structures protrude, namely a resilient clip 44 having a tooth 46, a finger 48 having a generally rectangular footprint and a detent member 50 having a generally square footprint. Each of these three structures extends from a floor 52 which is recessed below an abutment surface 54, with the structures extending above the abutment surface.

Figure 12:
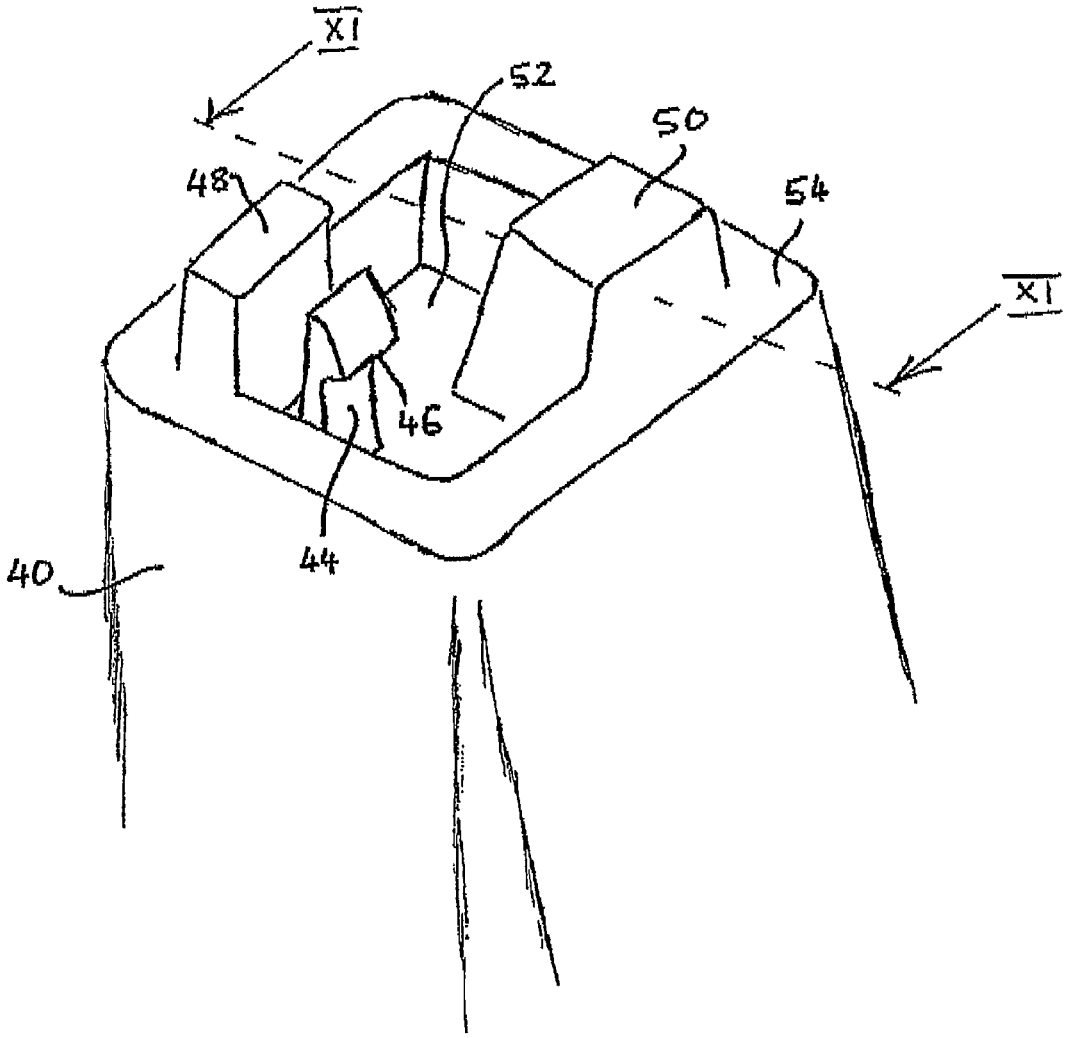
FIG. 12 shows a simplified view of the connecting components in the detail of FIGS. 9 and 10.

For ease of understanding, a simplified view of the mechanism is shown in FIGS. 11A and 11B before and after engagement, respectively. Furthermore, a stylised view of the mechanism is shown in FIG. 12. Reference can be made to FIGS. 9 to 12 collectively in the description which follows.

FIGS. 11A and 11B are taken in cross section as a pair of support posts 40, one from each of a pair of sub-units, approach one another and engage. The lower post is shown along a section taken on the dotted line indicated as XI-XI in FIG. 12.

On the descending support post 40 (FIG. 11A), the resilient clip 44 and the finger 48 lie in the plane of the drawing and are seen in section, while the detent member 50 is behind the plane of the drawing and is therefore seen in elevation. On the ascending support post 40', the opposite applies, and it is the detent member 50 whose cross section lies in the plane of the drawing.

It can be seen that detent member 50 has a detent surface 56 which underhangs a sloped surface 58. A sloped surface 60 on tie leading end of the descending clip 44 will thus contact and slide along the sloped surface 58. This temporally deforms the clip 44 until the tooth 46 on the clip has passed the underhanging detent surface 56 on the detent member 50, at which point the detent member and the clip are locked together as shown in FIG. 11B.

Those portions of each detent member 50 and finger 48 which protrude above the abutment surface 54 are accommodated in the recess (defined by the floor 52) on the opposing support post. The detent member 50 on one support post will be positioned alongside the detent member on the other support post, and similarly the fingers 44 will be alongside one another. The entire structure therefore interlocks snugly together and no torsional movement is possible, and nor is any translational (lateral) movement. The mechanism therefore locks completely and permanently together when the support posts are compressed together as shown in FIGS. 11A and 11B.

Referring back to FIGS. 9 and 10, it can be seen that the support post and the structures thereon are aligned along axes disposed at an angle of 45 degrees to the primary axes of the sub-unit. In other words, if a diagonal line is drawn from one corner of the sub-unit to the opposite corner, the support post and it's locking components will be aligned parallel and normal to that diagonal line (and not parallel or normal to the edges of the unit per se.

This provides a very useful effect—a pair of identical sub-units can be made to engage and lock with one another provided only that the square faces are aligned. In other words, rotating one or other unit by 90 degrees or any multiple thereof has no effect on the locking mechanism. Typically, when two such identical items are self-locating and locking, it is necessary to orient them so that (say) a male component on one unit is located opposite a female component on the other unit, and rotating one of the units by 90 degrees will make the two units incompatible. However, the rotation of the locking mechanisms by 45 degrees has been fund to allow two identical units to self-lock without any special orientation, making the assembly of units trivial.

More particularly, each pair of structures on a sub-unit which engage with the same pair of structures on an opposed sub-unit (for example the clip 44, and the detent 50) are disposed to the (i) on either side of the major (corner-to-corner) diagonal of the sub-unit, (ii) equidistant from that diagonal, and (iii) the line connecting the pair of structures is perpendicular to that major diagonal. While not immediately apparent if a given clip (clip "X") on a sub-unit engages with a particular recess or hole (hole "Y") on an opposed sub-units then examination of a single sub-unit will show that clip "X" and hole "Y" form a pair of structures which fulfils conditions (i) to (iii) also.

Figure 13:
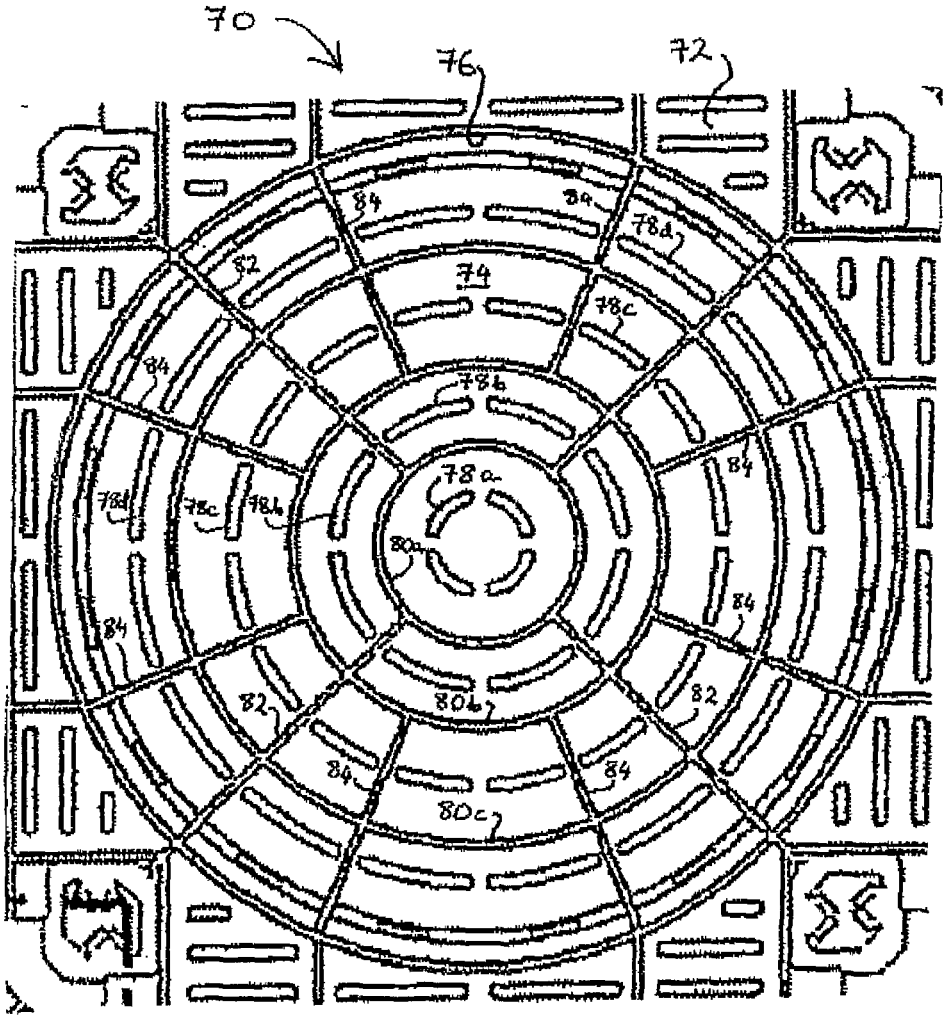
FIG. 13 is a plan view of a detail of a circular cut-out in the centre of a sub-unit.

Referring next to FIG. 13, a plan view of a detail at the centre of a sub-unit is shown from above the top face (or below the bottom face).

The top/bottom face of a sub-unit is of course not a planar face but has a depth, and therefore has an outer surface 72 visible from the exterior of the finished unit and an inner surface 74 which is mostly hidden below the outer surface and exposed only to the interior of the unit. However, the circular cut-out structure, indicated generally at 70, has a perimeter 76 at which the outer surface terminates and within which the inner surface can be seen. A series of concentric circular perforations 78*a*, 78*b*, 78*c*, 78*d* are provided in the inner surface.

In the annular areas between adjacent concentric perforations 78*a*-78*d*, a series of concentric circular walls 80*a*, 90*b*, 80*c* rise from the inner surface 74. These walls 80 terminate at the level of the top surface as can be readily seen in FIG. 1.

Four primary radial ribs 82 extend diagonally outwards from the circumference of the innermost wall 80*a* to the perimeter 76, in the primary diagonal directions of the face (from the centre to each corner). Eight secondary radial ribs 84 extend outwards from the circumference of the second wall 80*b* to the perimeter 76.

Each of die concentric perforations 78*a*-78*d* allows a jig saw or other cutting implement to remove a circular area of the inner surface 74. The portion of the ribs 82, 84 between the chosen perforation and the mediately surrounding wall can also be cut away to result in a cylindrical receiver with a lower annular lip, and an access pipe can be inserted into this receiver to enable inspection devices to be lowered though the access pipe into the interior of a unit.

Figure 14:
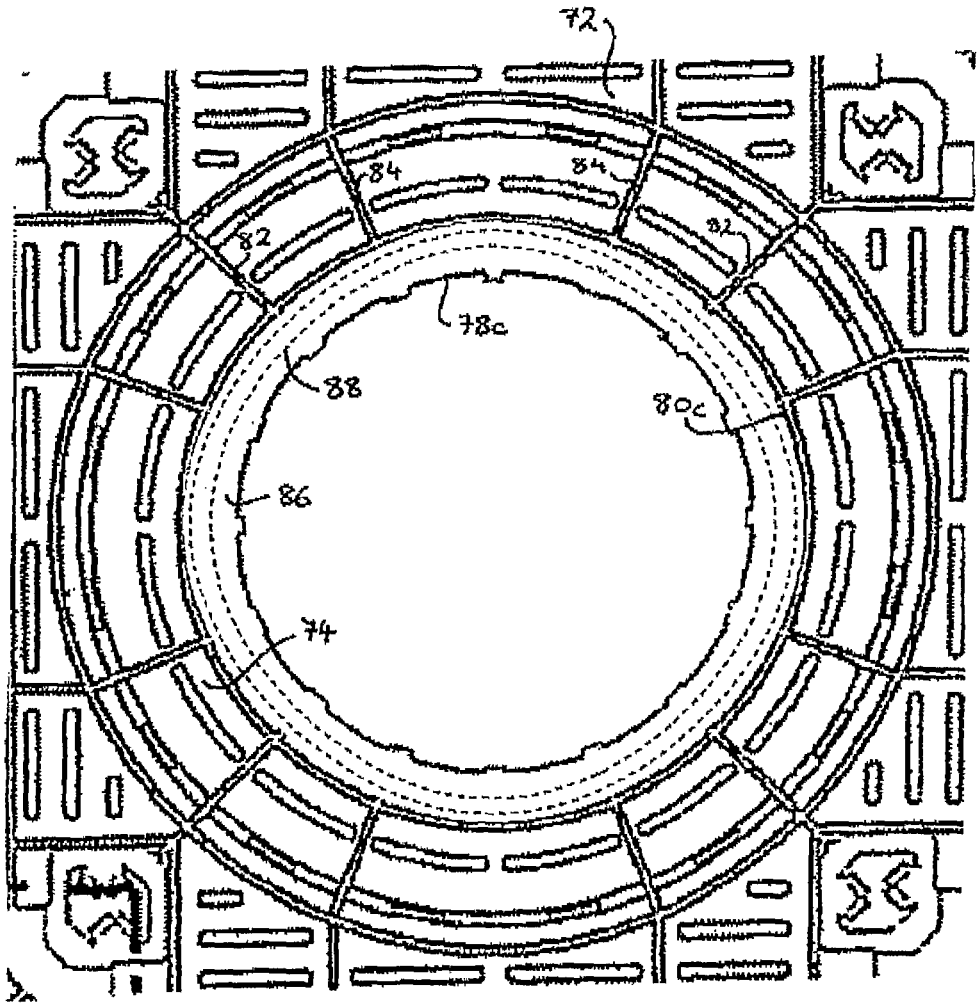
FIG. 14 is a plan view of the detail of FIG. 13, when a first portion of the circular cut-out has been removed.

Referring to FIG. 14, the inner surface 74 has been cut around the perforation 78*c* in this way, and the primary and secondary ribs 82, 84 have each been cut away to the radius of the outermost wall 80*c*.

The outermost wall 80*c* therefore defines a sylindrical receiving space extending between the outer surface 72 and the shelf or lip 86 provided on the inner surface 74.

A pipe 88 (shown in dotted outline) can thus be inserted into the cylindrical space defined within the interior of the wall 80*c* to rest on shelf 86 and provide a permanent access tube above the selected cell. Because the circular cut-out structure 70 is provided over the centre of the sub-unit, if a camera or other optical device inserted down through pipe 88 can look along each of the four cardinal directions (towards the top, bottom, left and right of the drawing figure) so that there is an unobstructed view alone the passages defined between each of the corner pillars.

Figure 15:
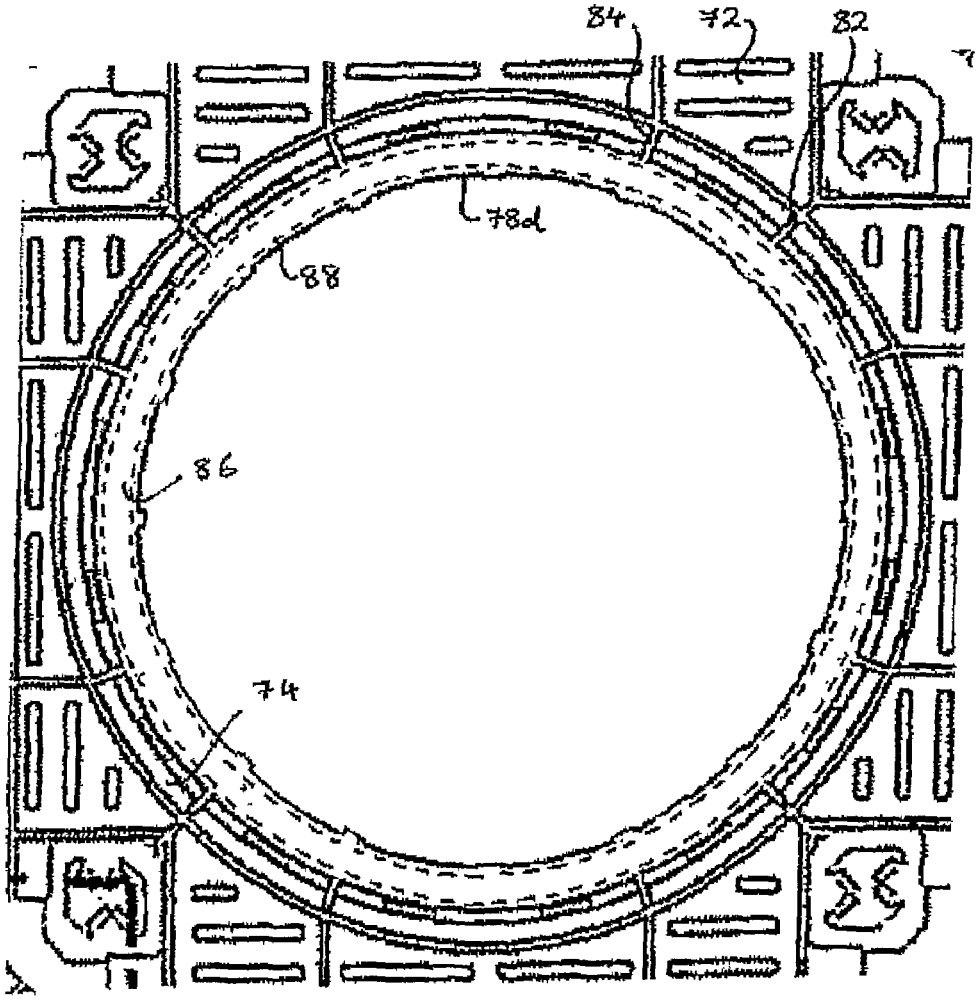
FIG. 15 is a plan view of the detail of FIG. 13, when a second portion of the circular cut-out has been removed.

In FIG. 15, the outermost perforation 78*d* has been cut away to accommodate a larger diameter of pipe 88, and the ribs 82, 84 have been cut back part of the way to the outer perimieter so that they define a generally cylindrical space similar to that provided by the wall in FIG. 14.

The invention claimed is:

1. A modular subsurface stormwater unit of generally cuboid external form having equal rectangular top and bottom surfaces spaced apart by a set of four pillars, each of which runs from a corner of the top surface to a corresponding corner of the bottom surface, said pillars defining therebetween a void having a generally cruciform cross section, said void opening onto each of the four side faces defined between the roof and the base, wherein the faces of the unit comprise a lattice network of ribs and struts.

2. A modular subsurface stormwater unit as claimed in claim 1, wherein the cuboid units are generally cubic and thus the rectangular top and bottom faces are square and equal to each of the four side faces.

3. The modular subsurface stormwater unit as claimed in claim 1, wherein the faces of the unit are liquid permeable.

4. The modular subsurface stormwater unit as claimed in claim 1, wherein the faces of the unit are reticulated.

5. The modular subsurface stormwater unit as claimed in claim 1, wherein the unit further comprises a plurality of mating connectors disposed about the periphery of the unit, the connectors configured to allow separate units to be connected together so that the void openings of separate units are aligned, the respective voids in each unit forming a throughway.

6. A sub-unit of a modular subsurface stormwater unit, the sub-unit comprising a generally square face having a set of four half-pillars extending therefrom, one at each corner of the face, each half-pillar terminating at a mating connection which is adapted to mate with an identical mating connection of another identical sub-unit to provide a generally cuboid modular unit, the mating connections of the four half-pillars being disposed such that when two sub units are brought into engagement with their square faces aligned and the mating connections approaching one another, each of the mating connections on one sub-unit engages with a complementary mating connection on the other sub-unit, for each of the four aligned orientations of the two square faces.

7. A sub-unit as claimed in claim 6, wherein each mating connection has a first structure and a complementary second structure, the first and second structures being arranged such that when two sub-units are brought into engagement as aforesaid each first structure on one of said sub-units is aligned with and engages with a second structure on the other of said sub-units and vice versa, and this remains true, even if one of the sub-units is rotated through 90, 180 or 270 degrees relative to the other.

8. A sub-unit as claimed in claim 6, wherein each pair of first and second structures is arranged such that when projected onto the plane of the square face, the first and second structures are symmetrically disposed about a notional diagonal extending from one corner of the square face to the opposite corner.

9. A modular subsurface stormwater unit of generally cuboid external form having equal rectangular top and bottom surfaces spaced apart by a set of four pillars, each of which runs from a corner of the top surface to a corresponding corner of the bottom surface, said pillars defining therebetween a void having a generally cruciform cross section, wherein the top surface is provided with a central cut-out between the pillars to enable an inspection access point to be readily created in the top of any such unit in a system of laterally adjoined units by removing said cut-out, and wherein the cut-out comprises a series of concentric circular perforations in the top surface.

10. The modular subsurface stormwater unit as claimed in claim 9 wherein a series of concentric circular walls are located on the top surface, and are disposed in the spaces between adjacent perforations.

11. The modular subsurface stormwater unit as claimed in claim 9, comprising an access area which is removable in order to provide access to the contained void.

12. The modular subsurface stormwater unit as claimed in claim 11, wherein the access area is irreversibly removable.

13. The modular subsurface stormwater unit as claimed in claim 11, wherein the access area comprises a plurality of concentric circles frangibly connected together and removable independently and/or simultaneously.

* * * * *